US006276581B1

(12) United States Patent
Glock

(10) Patent No.: US 6,276,581 B1
(45) Date of Patent: Aug. 21, 2001

(54) HOLSTER FOR A FIREARM

(76) Inventor: Gaston Glock, Hausfeldstrasse 17, A-2232, Deutsch-Wagram (AT)

( * ) Notice: Subject to any disclaimer, the term of this patent is extended or adjusted under 35 U.S.C. 154(b) by 0 days.

(21) Appl. No.: 09/358,135

(22) Filed: Jul. 20, 1999

(51) Int. Cl.[7] ..... F41C 33/02
(52) U.S. Cl. ..... 224/244; 224/911
(58) Field of Search ..... 224/191, 192, 224/242, 243, 244, 911, 912

(56) References Cited

U.S. PATENT DOCUMENTS 1,635,984 * 7/1927 Corriston ..... 224/244
1,750,139 * 3/1930 Swift ..... 224/244
2,349,376 * 5/1944 Ray ..... 224/244
2,551,913 * 5/1951 Toby ..... 224/244
4,256,243 * 3/1981 Bianchi et al. ..... 224/244
4,318,503 * 3/1982 Capano ..... 224/244
5,275,317 * 1/1994 Rogers et al. ..... 224/244
5,284,281 * 2/1994 Nichols ..... 224/244
5,467,909 * 11/1995 Resca et al. ..... 224/244
5,810,221 * 9/1998 Beletsky et al. ..... 224/244

* cited by examiner

*Primary Examiner*—Gregory Vidovich
(74) *Attorney, Agent, or Firm*—Kilpatrick Stockto

(57) ABSTRACT

Holster for a firearm, especially a handgun with a trigger guard, in which a safety catch is mounted in a housing to pivot around a pivot axis. The pivot axis has a locking tab which contacts the inside of the trigger guard.

2 Claims, 6 Drawing Sheets

HOLSTER FOR A FIREARM

BACKGROUND OF THE INVENTION

Field of the Invention

The invention concerns a holster for a firearm, especially a handgun, with a trigger guard.

A wide variety of safety requirements are now imposed on holsters. They not only are supposed to store the weapon safely and mechanically protect it, but also reliably prevent theft or snatching of the weapon from the holster by another person, for example, in the event of a scuffle.

However, it is also required at the same time that the lawful user should be able to draw the weapon at any time quickly and unhampered without additional activities or even the use of the other hand.

A holster is known from U.S. Pat. No. 5,573,157 A in which an elastic tongue engages in the trigger guard from the side. When the weapon is to be pulled, an activation device whose handle is situated between the holster and the user must be pressed down so that the elastic tongue is pushed away by a type of wedge and the trigger guard of the weapon, and thus the weapon itself is released. When the weapon is inserted, the elastic tongue is deformed so that the trigger slides past it, the elastic tongue springing back into its initial position after passing the trigger guard and thus blocking the weapon.

This arrangement has the drawback that the handle must be pushed over a relatively long path to activate the elastic tongue and that during longer use in the open the elastic tongue can be fixed in its released position by penetration of soiling and foreign objects so that sufficient safety does not exist. The fact that a significant mechanical stress occurs because of the large path that the elastic tongue covers, through which fatigue phenomena occur in the area of the spring during frequent use or longer wearing, which ultimately leads to failure of the spring, is added to this.

Another holster is known from WO 98/40686 A. In this holster, on the one hand, holding of the weapon occurs by means of magnets, which cooperate with magnetizable components of the weapon, security against inadvertent or undesired removal of the weapon from the holster is provided by a safety pin, which is mounted to move essentially perpendicular to the plane of symmetry of the weapon and also extends into the region of the trigger guard and is secured by a spring in its motion path during removal of the weapon from the holster. By means of a wing-like activation device, which has an oblique plane, it cooperates with an also oblique entry plane of the pin; the safety pin can be pushed against the force of the spring from the movement region of the safety guard when the weapon is to be removed from the holster. It is proposed in one embodiment to fix the activation lever or safety pin in the locked position with a lock in order not only to stow the weapon in the holster, but also to safely store it.

When the safety pin also has a beveling on the side facing the open side of the holster in order to be pushed by this during insertion of the weapon, it is not possible in a commercially available holster of this type to introduce the weapon to the holster without operating the handle, which naturally significantly reduces comfort during use.

Moreover, because of the sliding movement between the handle and the safety pin along the two oblique surfaces either the activation path or the force to be applied for release is inconveniently large, which in both cases is irksome and leads to handling errors, especially when the weapon is to be quickly and reliably drawn in an emergency even by untrained persons.

BRIEF SUMMARY OF THE INVENTION

The objective of the invention is to devise a holster that does not have these drawbacks and in which a handgun, on the one hand, is secured in the holster reliably and safely even in the presence of significant extraction forces and, on the other hand, the activation device to release the weapon is operated with minimal expenditure of force and only a minimal activation path of the mechanism occurs for release.

For this purpose, it is proposed according to the invention that a blocking hook be arranged in the holster in the region in which the trigger guard of the weapon being stowed lies in the inserted state, this hook being rotatable around an axis that runs parallel to the plane of symmetry and perpendicular to the barrel axis of the weapon being inserted, in which the blocking hook has a pressure surface on the side of the pivot axis opposite the hook on which the trigger guard comes to lie during insertion of the weapon and loads the safety catch with a torque in the direction toward its locked position, and by the fact that the safety catch has an activation tab on the side opposite the contact surface with reference to its pivot axis, on which a thrust element engages to open the blocking hook.

Because of this expedient, the previously known path- and force-intensive activation devices with a wedge effect are replaced by virtually pure rotational movements and linear movements to exert pressure or tension so that the mechanical efficiency of the device is substantially increased, which benefits both the forces to be applied and the paths to be covered and in this manner also increases the functional reliability and lifetime of the device.

BRIEF DESCRIPTION OF THE DRAWINGS

The invention is further presented below with reference to the drawing. In the drawing.

DETAILED DESCRIPTION OF PREFERRED EMBODIMENTS

Figure 1:
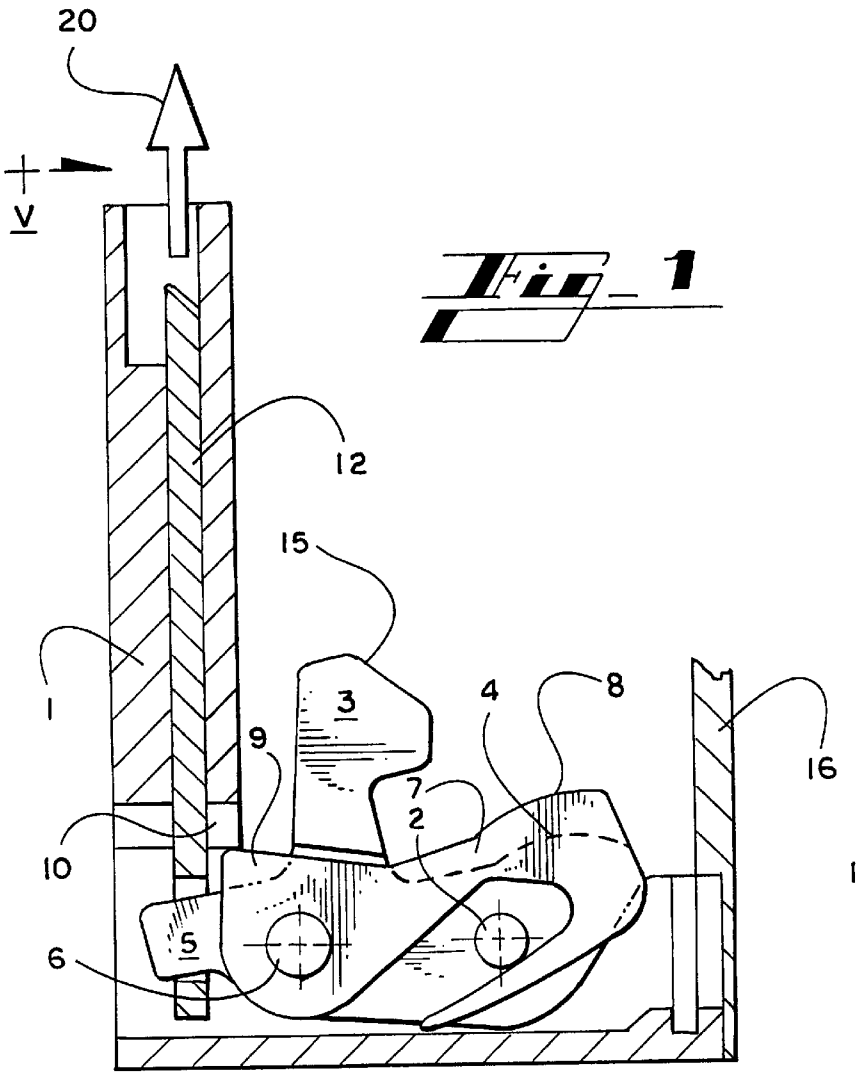

FIG. 1 depicts purely schematically a holster according to the invention in section, in which only the region of the holster that accommodates the trigger guard when the weapon is inserted is depicted. The sectional plane, referred to the weapon being inserted, runs parallel to its barrel and perpendicular to its plane of symmetry.

FIG. 1 shows a holster housing 1 in which a pivot axis 2 is arranged around which a safety catch 3 can be mounted to pivot. The safety catch 3 has a pressure surface 4, which is intended to come in contact with the outside of the safety guard of the weapon being inserted.

The safety catch 3 has an activation tab 5 on its side opposite pressure surface 4 with reference to pivot axis 2, which serves to rotate the safety catch 3 into its release position when the weapon is to be drawn, in cooperation with an activation device to be further explained below.

The safety catch 3 also has a pivot axis 6 on which a safety plate 7 is mounted to pivot. This safety plate 7, which is arranged essentially parallel to safety catch 3, has an activation surface 8 in the region adjacent to pressure surface 4 of safety catch 3, which, as is apparent from FIG. 1, lies closer to the top, i.e., the opening of the holster, than the pressure surface 4 of safety catch 3. This position of activation surface 8 and the entire safety plate 7 is achieved in that the safety plate 7 is exposed to a torque from a spring, which seeks to rotate the safety plate (in the depiction according to FIG. 1) counterclockwise.

The safety plate 7 has a contact tab 9 on the side facing away from its activation surface 8, which lies against a countersurface 10 of the housing 1 of the holster.

The activation tab 5 of safety catch 3 also protrudes in the depicted practical example into an opening 11 of a slide 12, which serves to bring safety catch 3 into its releasing position counterclockwise.

Figure 2:
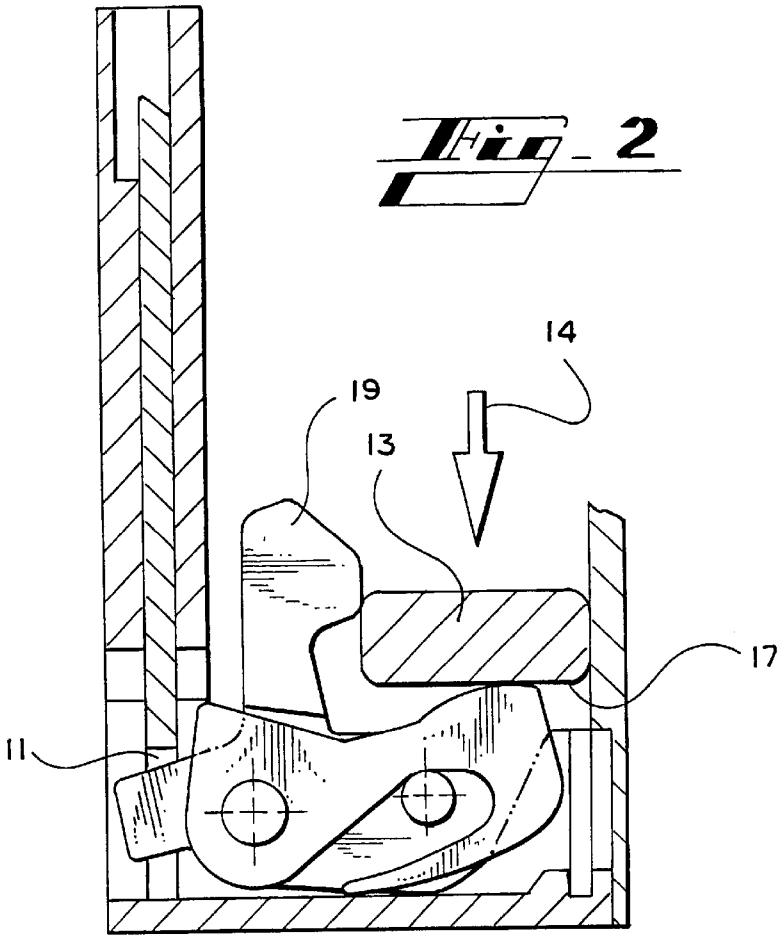
FIGS. 1–4 show a holding device according to the invention in a holster.

The method of operation of the device is further explained with reference to the sequence of FIGS. 2, 3, and 4:

When a weapon is inserted into the holster the trigger guard 13 of the weapon enters the region of a guide surface 15 of safety catch 3 in the direction of arrow 14 and forces this counterclockwise from the motion path of trigger guard 13, in which this is forced against the outer holster wall 16, as is apparent from FIG. 2.

During this downward movement in the direction of arrow 14, the outside 17 of trigger guard 13 pushes on the activation surface 8 of safety plate 7 and pivots it clockwise against the spring force loading it around pivot axis 6 and by meshing of contact tab 9 and countersurface 10 around a virtual axis of rotation in this region, in which the safety catch 3 (entrained via pivot axis 6) is simultaneously rotated counterclockwise so that sliding of trigger guard 13 on safety catch 3 is facilitated.

The safety plate 7 is also moved in translatory fashion by this pivoting of pivot axis 6 counterclockwise around pivot axis 2 so that the contact tab 9 is ultimately released from countersurface 10 of housing 1. The moment of this release is shown in FIG. 2. Almost simultaneously with this release, the trigger guard 13 during further movement in the direction of arrow 14 also reaches the pressure surface 4 of safety catch 3 and now begins to load this clockwise in its blocking direction so that fixation of the weapon finally occurs.

Figure 3:
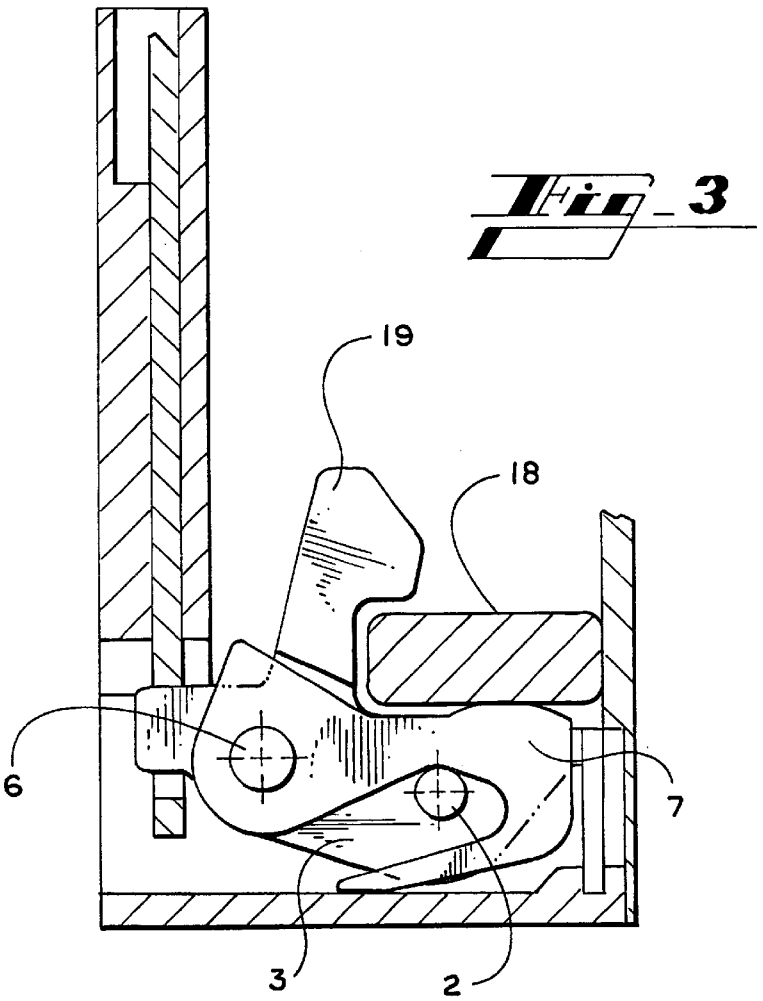

As is apparent from FIG. 3, the safety catch 3 with its locking tab 19 encloses the inside of trigger guard 13 and prevents any movement in the direction opposite arrow 14, ignoring the necessary limited play.

Figure 4:
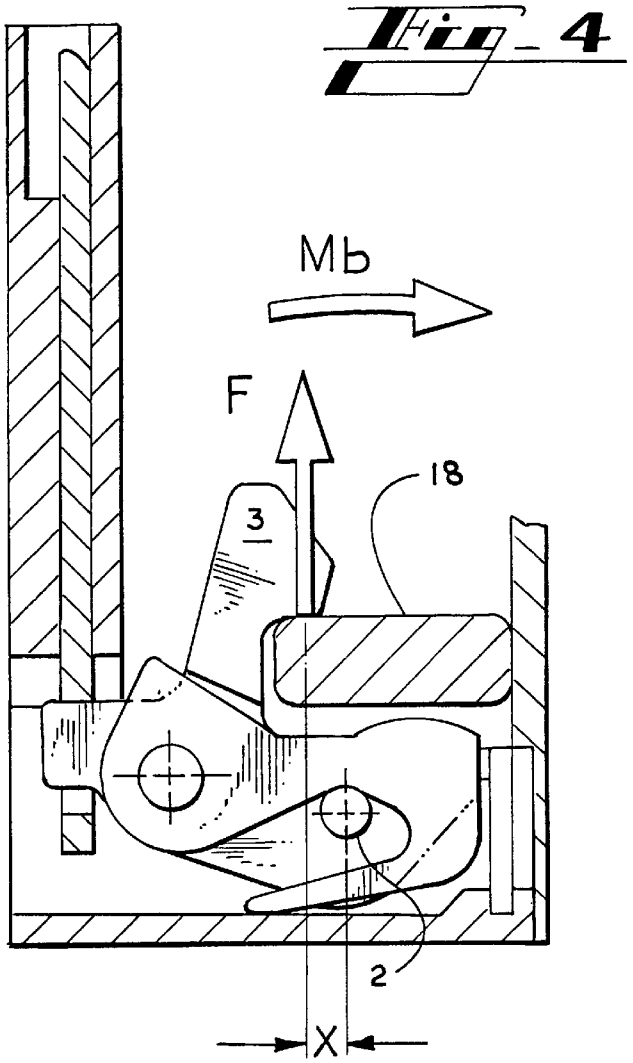

FIG. 4 shows the principle of self-inhibition, which is applied in a preferred embodiment of the invention. The resulting force F, which acts on the safety catch 3 during movement of trigger guard 13 in the extraction direction, i.e., against the direction of arrow 14, produces a torque around its pivot axis 2 in the direction of arrow Mb and prevents any release movement (counterclockwise rotation) of safety catch 3. This is achieved in that the contact surface between the locking tab 19 and the inside 18 of trigger guard 13 is restricted to such a region that each extraction force F (distance x to the axis of rotation) generates a torque in the blocking direction.

To release the weapon it is only necessary to move the slide 12 opposite the direction of arrow 20 (FIG. 1) so that the safety catch 3 is pivoted counterclockwise around its pivot axis 2 so that the trigger guard 13 is released and can be pulled from the holster in the direction of arrow F (FIG. 4). During this movement of slide 12, the contact tab 9 is guided along counter-surface 10 by copivoting of pivot axis 6 and spring loading of safety plate 7, counterclockwise and is held in this pivoted position so that at the end of activation of slide 12 by spring loading of safety plate 7, the contact tab 9 is reengaged beneath countersurface 10 and has reached the position depicted in FIG. 1.

As can be gathered from the above explanation, in order to achieve the objective according to the invention, it is not necessary to provide the safety plate 7 with its contact tab 9 and countersurface 10 if this is favorable also to increase comfort during use. It must be pointed out that during insertion of the weapon into the holster, the entire weight of the weapon ordinarily supports the insertion movement and that the friction force between trigger guard 13 and guide surface 15 can be much more easily overcome with the entire hand during insertion of the weapon and is much less interfering than the friction movements in the activation devices of the already known holsters, which need be activated in each case during drawing of the weapon and only with one finger in the direction against removal of the weapon.

Figure 6:
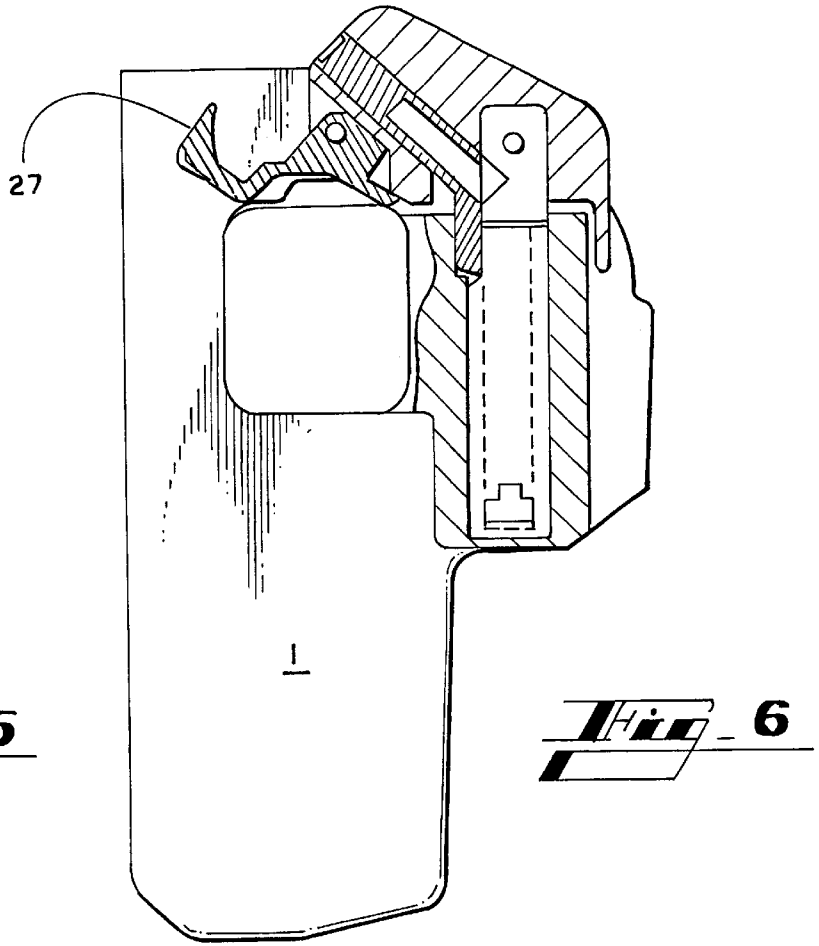
FIGS. 5 and 6 show an embodiment of the holster according to the invention, partially in section in the locked and released position.
Figure 5:
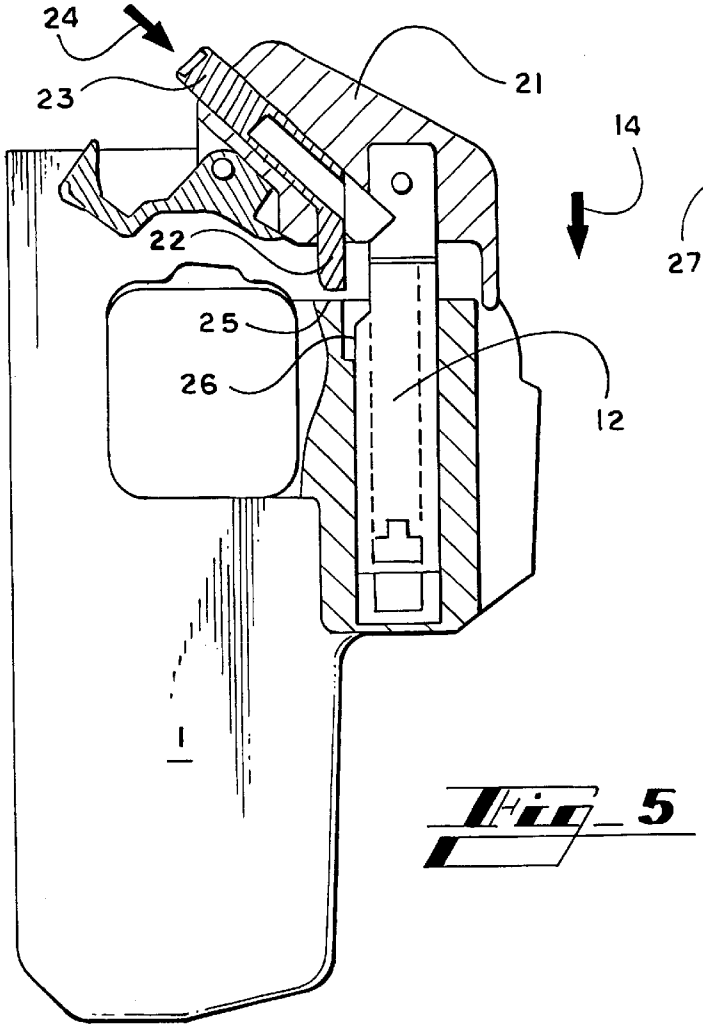

The invention even lends itself advantageously to an additional embodiment that is apparent from FIGS. 5 and 6.

These two figures show a holster according to the invention in the direction of arrow V in FIG. 1, partially in section. Here again the holster region is depicted, especially above the detail depicted in FIGS. 1 to 4.

The slide 12 mounted to move in the housing 1 of the holster is apparent, which on its upper end is connected to an activation device 21. During movement of the activation device 21 in the direction of arrow 14, the slide 12 is correspondingly moved and the aforementioned sequence of movements occurs. To further increase the safety of the holster, a blocking pin 22 is provided in a preferred variant, which sits on a depressor 23, in which the depressor 22 is moveable in the direction of arrow 24, and therefore obliquely to arrow 14.

In the position depicted in FIG. 5, the blocking pin 22 is opposite a stop surface 25 with its end so that during activation of activation device 21 in the direction of arrow 14, the blocking pin 22 strikes stop surface 25 and prevents any further movement and thus release of the weapon. However, if the depressor 23 is pushed against the force of a spring (not shown) in the direction of arrow 24, the blocking pin 22 goes from the region of stop surface 25 into the region of a recess 26 and the activation device 21 can be pushed in the direction of arrow 14 until the weapon is released. This engaged position is shown in FIG. 6, in which it is readily apparent that the blocking pin 22 finds a place in recess 26 and the depressor 12 essentially occupies the position depicted in FIG. 2 (but reached there by insertion of the weapon).

In order to further increase the safety of the holster, it is proposed in an advantageous embodiment to cover the depressor 23, if it is ensured that the weapon will not be needed for a longer time. This can be the case, in particular, among judicial guards, who must carry the weapon on duty, but are stationed, for example, in the interior of a police or court building.

Figure 8:
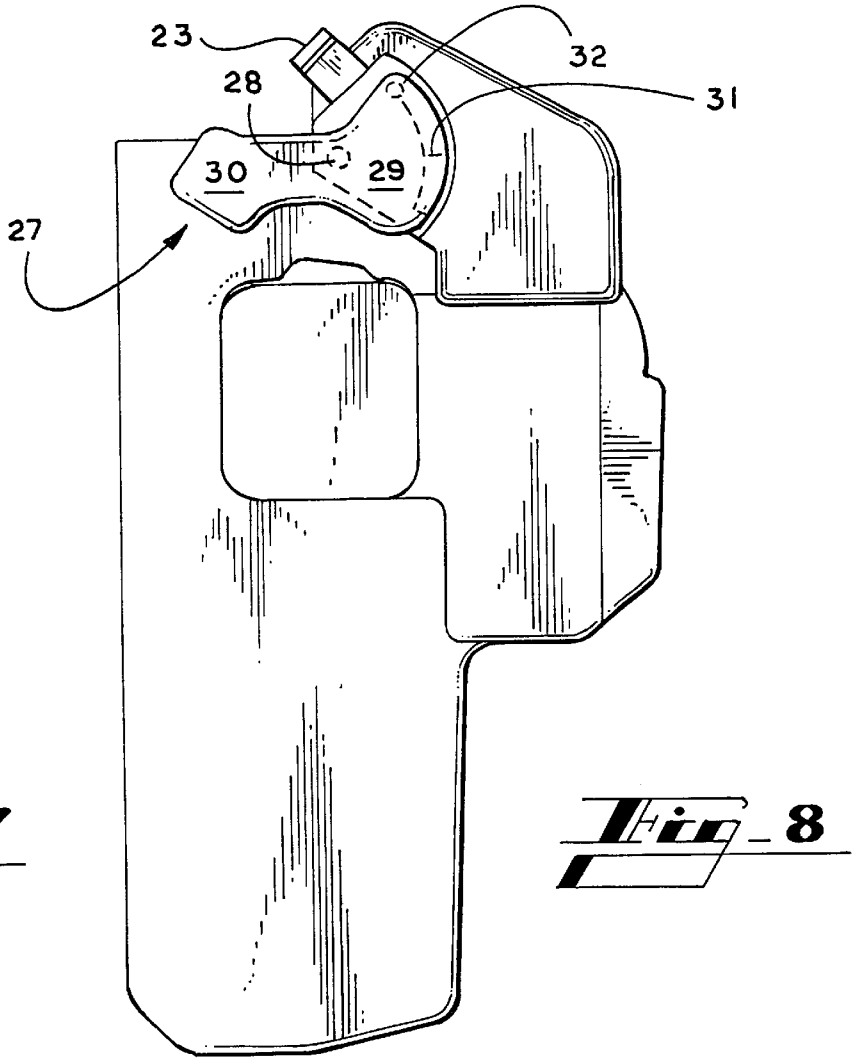
FIGS. 7 and 8 show another embodiment with an additional safety device and FIG. 9 shows a perspective view of the holding device according to the invention.
Figure 7:
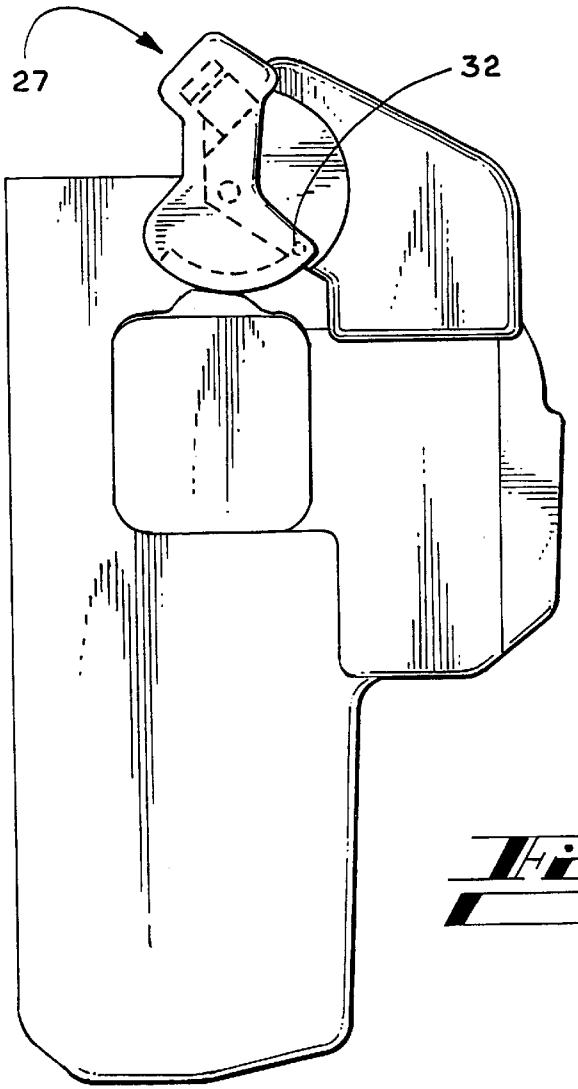

This type of covering is shown in detail in FIGS. 7 and 8. FIGS. 7 and 8 correspond to FIGS. 5 and 6, but in which no cutaway region is present, but the holster is shown in aspect in the direction of arrow 5 of FIG. 1.

The covering 27 according to the invention is arranged rotatable around an axis 28 and has a roughly bone-like shape. A section 29 having roughly the shape of a circular segment is then opposite the actual covering section 30. A track 31 is provided in segment section 29, in which a protrusion (not shown) of housing 1 can be pushed or moved when the cover 27 is rotated around its axis of rotation 28. A recess 32 is arranged at each end of track 31 and at close spacing from it, which can also accommodate the protrusion of the housing and therefore serves as a latch. The method of operation is as follows:

In the position depicted in FIG. 8, the depressor 23 is released, the ball or protrusion is locked into recess 32 and rotation of cover 27 is only possible using a certain initial force.

The position depicted in FIG. 7 shows the locked, secured position of cover 27, in which the bar protrusion has reached the other recess or catch so that release of the now covered depressor 23 is likewise possible only using noticeable force.

In addition, it is also possible to bring the cover close to its two end positions so that the ball or protrusion extends into track 31, which does not grade directly into the catch, but ends just in front of it so that additional force is also required for locking, although this is not as great as during unlocking. Because of this is it possible to bring the cover 27 almost to the position depicted in FIG. 7 in situations in which the user does not wish to release depressor 23, but on the other hand, feels threatened enough that he does not want to apply the necessary force for unlocking in an emergency, so that any undesired activation of depressor 23 is still prevented, but, on the other hand, rapid access without exertion of a special effort is possible.

Figure 9:
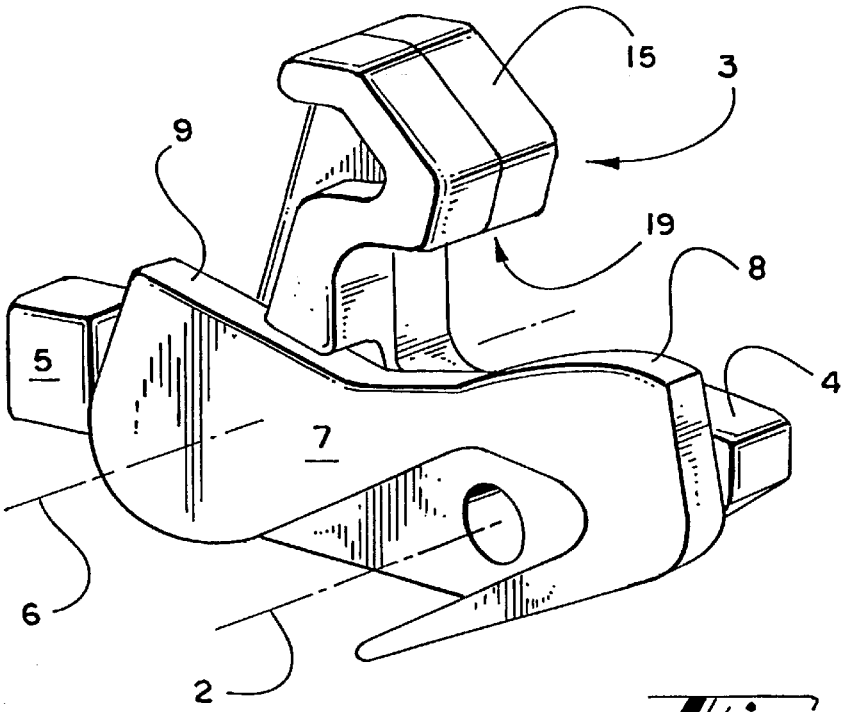
Figure 11:
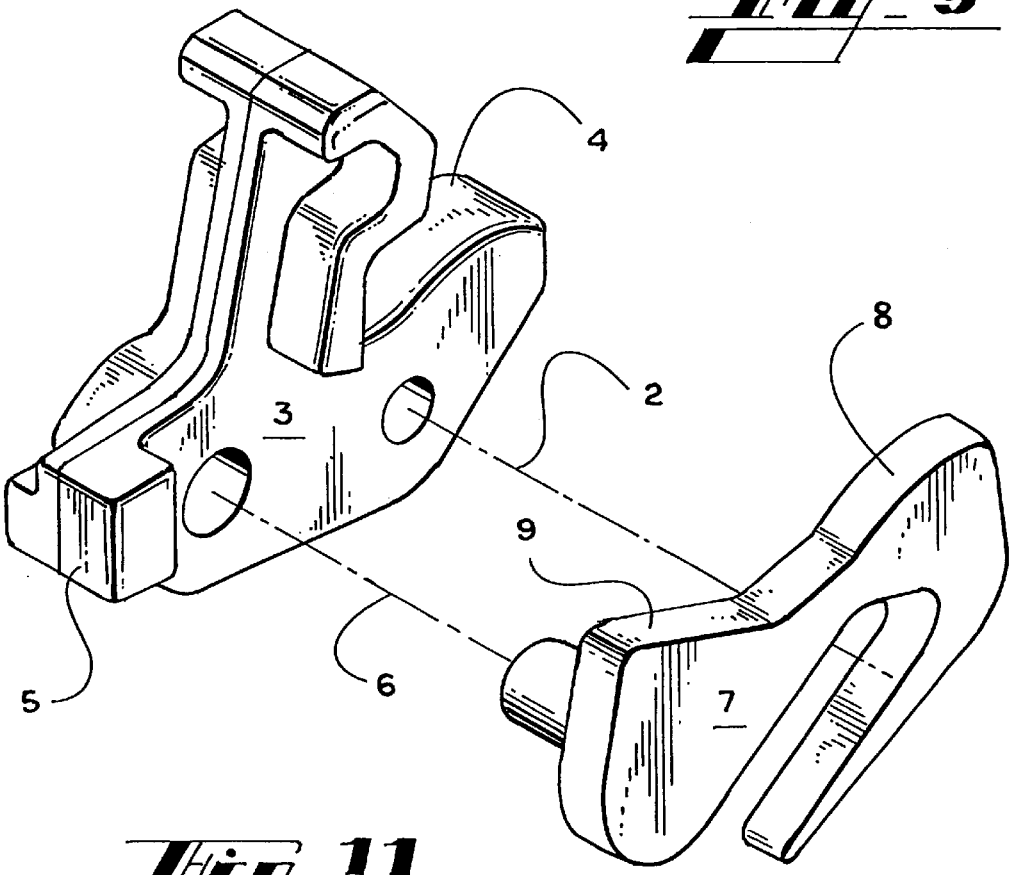
Figure 10:
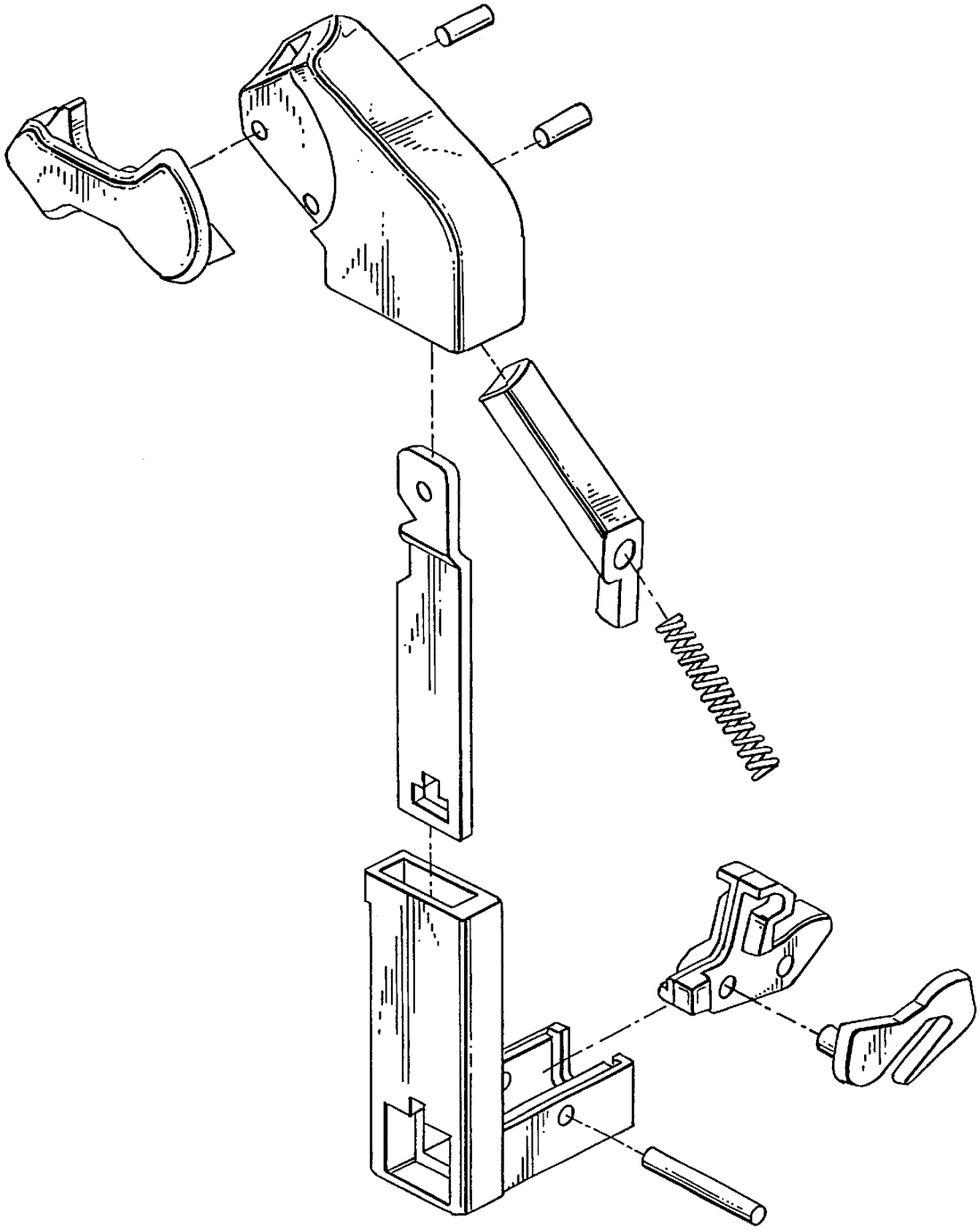

FIG. 9 shows the safety catch 3 and the safety plate 7 in a perspective view without the surrounding component. The elastic design of the safety plate 7 because of its needle-like spring tab enclosing the pivot axis 2 is readily apparent in particular. The staggered arrangement of the activation surface 8 and the pressure surface 4 is also readily apparent.

The invention is not restricted to the practical examples shown, but can be altered and varied in different ways.

Thus, it is not necessary that the safety catch 3 be mounted to pivot around the pivot axis 2 of housing 1 (or the safety plate around the pivot axis 6 of the safety catch), and this task can also be assumed by a sliding guide, even though mounting around a pivot axis is preferred for reasons of simpler manufacture.

The safety plate 7 in the depicted practical example is designed with a sickle-like shape with a bent end so that it is deformed during assembly so that it assumes itself the task of rotation spring around the pivot axis 6. It is naturally possible to provide an actual spring here, which can be either a torsion spring provided in the region of pivot axis 6 or a spring attached between housing 1 of the holster and a matching spring catch on the safety plate 7.

The pivot axes 2 and 6 are preferably designed in one piece with one of the two parts that they pivotally connect, which is readily possible if the components are made from plastic, like the entire holster. In this case the corresponding design of the injection molding die is easy to accomplish. In the area of application at issue it also does not play a disadvantageous role if the pivot axes produced in this way run slightly conical and not cylindrical in order to facilitate shaping. The corresponding mounting holes under some circumstances can also be provided with the same conical slopes in order to achieve flat mounting.

It is simple in the holster according to the invention to incorporate a blocking device, for which purpose a cam need only be prescribed in the safety catch 3, for example, which cooperates with the bottom of the activation tab 5 and prevents its downward movement. When this cam can be fixed in the blocking position by means of a key, the weapon is blocked in the holster and its trigger is inaccessible.

What is claimed is:

1. Holster for a firearm having a trigger guard (13), the holster comprising:

a safety catch (3) mounted to pivot around a first pivot axis (2) in a housing (1) of the holster, the safety catch having a blocking tab (19) for contacting the inside (18) the of trigger guard (13); and a safety plate (7) mounted on the safety catch (3) to pivot around a second pivot axis (6) parallel to the first pivot axis (2) against the force of a spring so as to force the safety catch into a locked position, and having a contact tab (9) which lies against a countersurface (10) of the housing (1) when the firearm is drawn and thus holds the safety catch (3) in an open position.

2. Holster for a firearm having a trigger guard (13), the holster comprising:

a safety catch (3) mounted to pivot around a pivot axis (2) in a housing (1) of the holster, the safety catch having a blocking tab (19) for contacting the inside (18) of the trigger guard (13);

the safety catch (3) having an activation tab (5) with which a slide (12) is operatively associated to act in an opening direction of the safety catch (3);

the slide (12) carrying an activation device (21) in which a depressor (23) is arranged obliquely to a displacement device (20) of the slide against the force of a spring;

the depressor carrying a blocking pin (22) which is opposite a stop surface (25) of the housing (1) in an unactivated position of the depressor (23) and a recess (26) in an activated position of the depressor;

a cover (27) connected to the housing (1) to rotate around an axis (28), which is rotatable between two end positions, in which the depressor (23) is covered in one of the end positions and the depressor (23) is accessible for activation in the other end position; and the cover (27) having a track (31) and at least one catch (32) in its extension, into which an element of housing (1) extends in order to achieve frictional position fixation of the cover (27) relative to the housing (1).

* * * * *